US010487603B2

(12) United States Patent
Manwill et al.

(10) Patent No.: US 10,487,603 B2
(45) Date of Patent: Nov. 26, 2019

(54) SYSTEM AND METHOD FOR FLOW DIVERSION

(71) Applicants: M-I Drilling Fluids U.K. Ltd., Westhill (GB); M-I L.L.C., Houston, TX (US)

(72) Inventors: Daniel Manwill, Provo, UT (US); Jim Shumway, Provo, UT (US); James Linklater, Buckie (GB); Jacques Orban, Katy, TX (US)

(73) Assignees: M-I Drilling Fluids UK Ltd, Aberdeen (GB); M-I L.L.C., Houston, TX (US)

( * ) Notice: Subject to any disclaimer, the term of this patent is extended or adjusted under 35 U.S.C. 154(b) by 211 days.

(21) Appl. No.: 15/122,048

(22) PCT Filed: Feb. 25, 2015

(86) PCT No.: PCT/US2015/017488
§ 371 (c)(1),
(2) Date: Aug. 26, 2016

(87) PCT Pub. No.: WO2015/130762
PCT Pub. Date: Sep. 3, 2015

(65) Prior Publication Data

US 2017/0016290 A1 Jan. 19, 2017

Related U.S. Application Data

(60) Provisional application No. 61/944,771, filed on Feb. 26, 2014, provisional application No. 61/983,501, filed on Apr. 24, 2014.

(51) Int. Cl.

| | |
|---|---|
| ***E21B 21/10*** | (2006.01) |
| ***E21B 34/06*** | (2006.01) |
| ***E21B 34/10*** | (2006.01) |

(52) U.S. Cl.
CPC ..... *E21B 21/103* (2013.01); *E21B 34/06* (2013.01); *E21B 34/10* (2013.01)

(58) Field of Classification Search
CPC ..... E21B 21/10; E21B 21/103; E21B 21/12; E21B 34/10; E21B 34/06; E21B 34/14;
(Continued)

(56) References Cited

U.S. PATENT DOCUMENTS 4,634,095 A * 1/1987 Taylor ..... F16K 47/04 137/625.37
6,263,969 B1 7/2001 Stoesz et al.
(Continued)

FOREIGN PATENT DOCUMENTS

WO 2012018700 2/2012

OTHER PUBLICATIONS

Oxford Dictionary: Rod, accessed 2018 https://en.oxforddictionaries.com/definition/us/rod (Year: 2018).*
(Continued)

*Primary Examiner* — David Carroll
(74) *Attorney, Agent, or Firm* — Jeffrey D. Frantz

(57) ABSTRACT

A flow diverter including a bypass element to divert at least a first portion of drilling fluid from a drill string to the borehole annulus. The first portion of fluid, or bypass flow, may be provided to the borehole annulus to clear cuttings generated by a drill bit of a BHA. The remaining fluid flow, or BHA flow, may be expelled through the bottom of the BHA. The fluid discharged through the BHA may enter the annulus and flow upward with the fluid flow diverted through the flow diverter to aid in clearing cuttings. The flow diverter also includes a choke housing disposed concentrically within a drill collar and containing a plurality of chokes to regulate bypass flow. An actuation system may be coupled to the flow diverter to control opening/closing of the chokes
(Continued)

and to measure flow rate of the first portion of fluid and/or the remaining fluid.

18 Claims, 15 Drawing Sheets

(58) Field of Classification Search
CPC ..... F16L 55/0331; F16L 55/02772; F16L 55/02754; F15D 1/004; G05D 7/014
See application file for complete search history.

(56) References Cited

U.S. PATENT DOCUMENTS

| | | | | |
|---|---|---|---|---|
| 2004/0112645 | A1 | 6/2004 | Eppink et al. | |
| 2009/0020292 | A1* | 1/2009 | Loretz | E21B 43/12 166/373 |
| 2009/0314974 | A1* | 12/2009 | Smirl | F16K 1/12 251/121 |
| 2012/0103692 | A1 | 5/2012 | White et al. | |
| 2014/0020955 | A1 | 1/2014 | Cramer et al. | |

OTHER PUBLICATIONS

International Search Report and Written Opinion issued in PCT/US2015/017488 dated Jun. 5, 2015; 14 pages.

* cited by examiner

SYSTEM AND METHOD FOR FLOW DIVERSION

This application is a U.S.C. 371 National Stage of International Patent Application No. PCT/US2015/017488, entitled "System and Method for Flow Diversion," filed on Feb. 25, 2015, which claims benefit to U.S. Provisional Applications No. 61/944,771, filed on Feb. 26, 2014, and No. 61/983,501, filed on Apr. 24, 2014, and each of these applications is incorporated reference in its entirety.

BACKGROUND

Various fluids are used in numerous applications for a variety of purposes, such as actuation of devices. For example, in wellbores, fluids are used to control pressure, move drill cuttings or waste from downhole to the surface, treat different conditions downhole, such as lost circulation, and various other purposes.

When drilling a borehole through subsurface formations, drill cuttings may accumulate in an annular space ("annulus") between the drill string, including the BHA, and the wall of the borehole. Transport of drill cuttings out of the borehole to the surface is performed by hydraulic drag on the cuttings from the mud as the mud is pumped through the drill string and exits through courses or nozzles on a drill bit at the end of the BHA. The effectiveness of cuttings transport may depend on the mud velocity, mud rheology, borehole inclination, cuttings size and cuttings density. When excessive amounts of cuttings build up in the annulus, the friction on the drill string increases with a corresponding increase of risk of the drill string becoming stuck in the borehole. The rate at which the borehole is drilled may be reduced until the excess cuttings are cleared away by the mud flow.

To help clear away the cuttings from the annulus while maintaining drilling rate, some of the mud flow may be diverted from the interior of the drill string directly to the annulus using a flow diverter. Such mud flow diversion may increase the velocity of the mud in the annulus. Mud having increased velocity in the annulus may provide better cuttings lifting and may clear the excess cuttings from the annulus. The mud flow diverted to the annulus from the drill string, however, may enter the annulus at a high velocity, this may increase the risk of fracturing some exposed subsurface formations and corresponding loss of mud.

Additionally, the mud flow rate through the BHA may be within a certain range for the BHA to function properly. If the mud flow rate is too low, the drilling process may not be performed adequately (such as drill bit cleaning and drilling tool operation). If the mud flow rate is too high, some components of the BHA may be damaged or destroyed. However, the required mud flow rate to ensure proper cuttings transport in the annulus may be too high to be transmitted through the BHA without risk of BHA damage.

DETAILED DESCRIPTION

In one aspect, embodiments disclosed herein relate to a flow diverter. More specifically, the present disclosure relates to a flow diverter employed as part of a drill string that diverts at least a portion of the downhole fluid flow into a borehole annulus located between the drill string and a wall of the borehole. Embodiments of the present disclosure provide an apparatus to reduce the pressure and or velocity of a fluid diverted to a borehole annulus. Embodiments of the present disclosure also provide examples of various geometries and methods of use for flow diverters.

Figure 1:
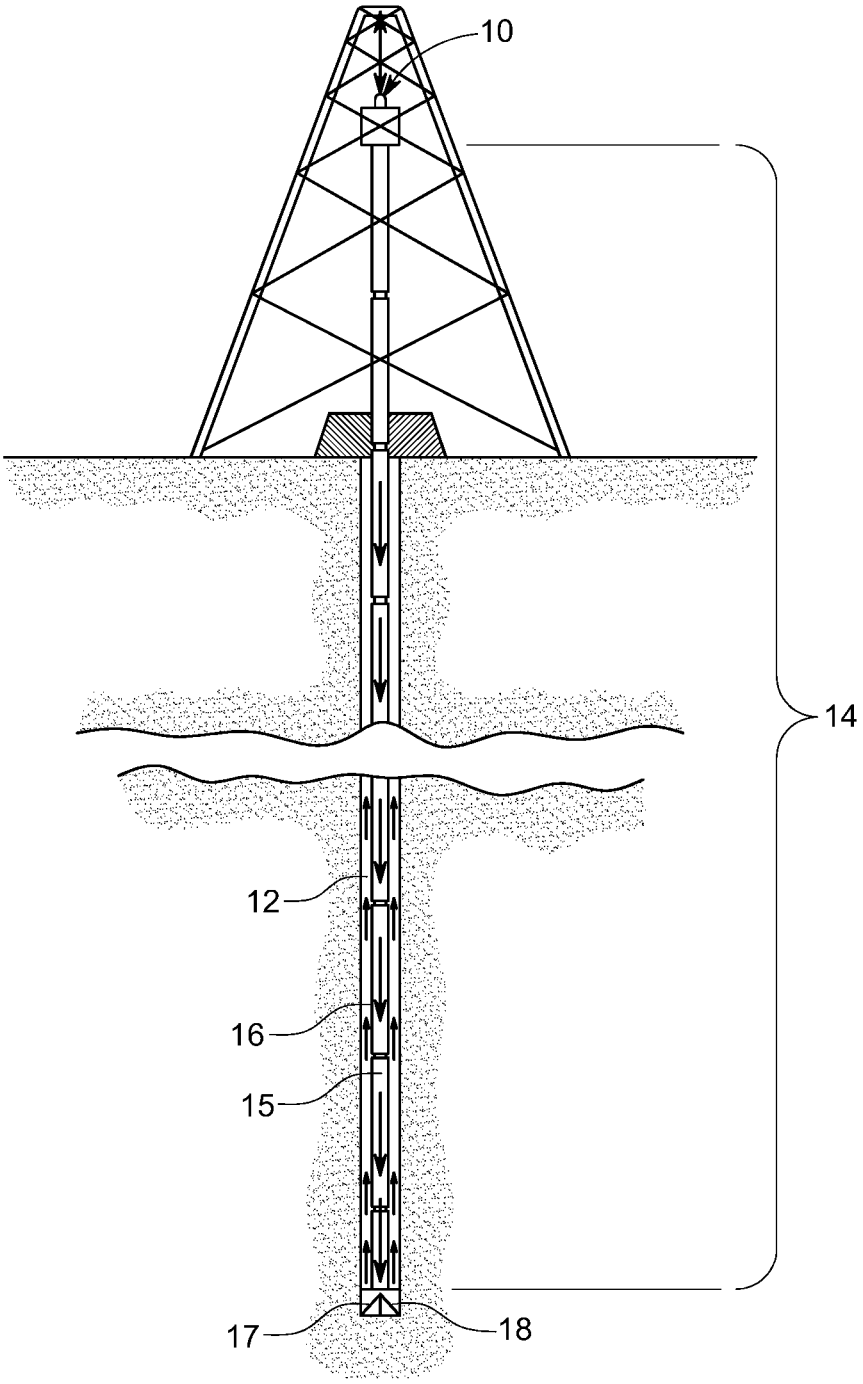
FIG. 1 shows a drilling system in accordance with embodiments of the present disclosure.

FIG. 1 shows a side view of a drilling system using a flow diverter. According to embodiments of the present disclosure, the drilling system includes a drill string 14, which may include a bottom hole assembly (BHA) 18 and a flow diverter 16. The drill string 14 may be suspended and moved longitudinally by a drilling rig 10 or similar hoisting device. The drill string 14 may be assembled from threadedly coupled segments ("joints") of drill pipe or other form of conduit. The drill string 14 may be disposed in a borehole such that an annulus 12 is formed between the drill string 14 and the walls of the borehole.

The BHA 18 may be provided to a downhole end of the drill string 14 to control the geometry and direction of the borehole. The BHA 18 may include, for example, a drill bit 17, a stabilizer (not shown), and a variety of monitoring tools 15. The monitoring tools 15 may include, for example, measurement while drilling (MWD) tools, rotary steerable tools, and logging while drilling (LWD) tools. The monitoring tools 15 may include communication devices (not separately shown) for transmitting various sensor measurements to the surface and/or for receiving command signals from the surface to enable and/or actuate components of the monitoring tools 15.

The flow diverter 16 may be coupled in the drill string 14 up-hole from the BHA 18. The flow diverter 16 may be provided to divert at least a first portion of drilling fluid provided to the drill string 14 to the borehole annulus 12. The first portion of fluid, also referred to as bypass flow (i.e. fluid diverted through the flow diverter 16), may be provided to the borehole annulus 12 to clear cuttings generated by the drill bit 17 of the BHA. The remaining fluid flow, that is a second portion of fluid, also referred to as BHA flow (i.e., the flow sent to the BHA 18) may be expelled through the bottom of the BHA 18. For example, the BHA flow may exit through drill bit 17. The fluid discharged through the BHA may enter the annulus 12 and flow upward with the fluid flow diverted through the flow diverter 16 to aid in clearing cuttings. As used in this disclosure, the terms "first portion of fluid flow" and "bypass flow" are used to refer to the same stream of fluid, while the terms "second portion of fluid flow" and "BHA flow" are used to refer to the same stream of fluid.

Figure 2:
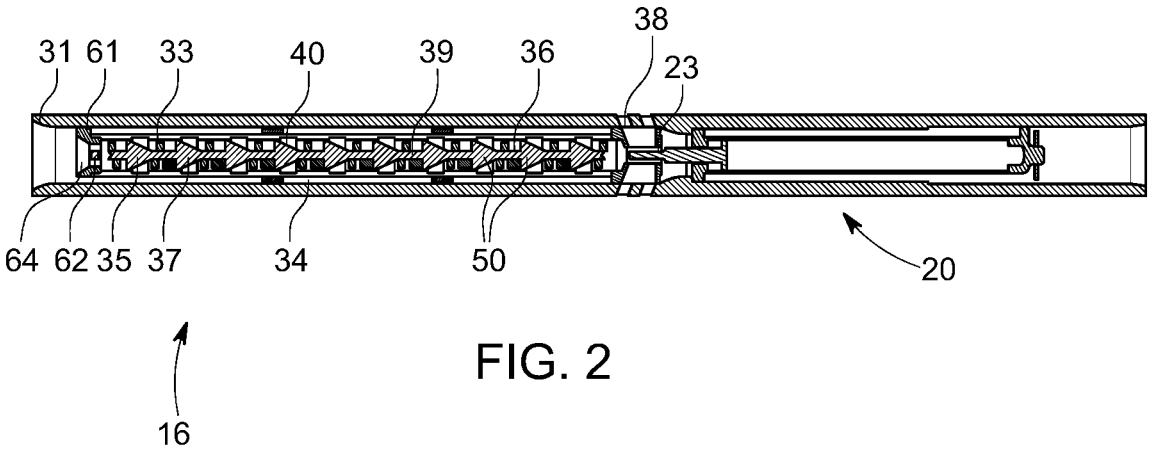
FIG. 2 shows a cross section of a flow diverter and actuation system in accordance with embodiments of the present disclosure.

Referring now to FIG. 2, the flow diverter 16 is shown connected to an actuation system 20. The flow diverter 16 includes a choke housing 33 disposed concentrically within the drill collar 31. The choke housing 33 may include an inner cavity 36 through which a first portion of fluid (i.e., the bypass flow) may travel. The flow diverter 16 may further include an outer cavity 34 between the interior wall of the drill collar 31 and the exterior wall of the choke housing 33 through which the second portion of fluid (i.e., BHA flow) may travel. Thus, the BHA flow flows down through the flow diverter 16 to the BHA to provide hydraulic flow, power, pressure, or actuation to the BHA and/or other downhole tools, while the bypass flow is diverted to the bore hole annulus, i.e., the annulus formed between the drill string and the formation.

The flow diverter 16 may also include a bypass element 61 proximate an upper end of the choke housing 33 that directs a first portion of fluid or bypass flow to the inner cavity 36 of the choke housing 33 and a second portion of fluid or BHA flow to the outer cavity 34 of the choke housing 33 to flow down to the BHA (not shown). The bypass element 61 may be a cylindrical tubular and may include at least one opening 62 in a radial wall of the bypass element 61 to allow the second portion of fluid to flow to the outer cavity 34.

The bypass element 61 may be disposed within the drill collar 31 up-hole of the choke housing 33. The fluid flowing into the drill collar 31 from the drill string first reaches bypass element 61. In the bypass element 61, the fluid flow is divided into two portions. A first portion of the split fluid flow passes into the choke housing 33 and into inner cavity 36 where it flows through a plurality of chokes 50 and choke seats 40 to establish bypass flow. The second portion of the fluid flow may pass through at least one opening 62 disposed in a radial wall of the bypass element 61. The at least one opening 62 directs the second portion of fluid into outer cavity 34 disposed between an outer wall of the choke housing 33 and an inner wall of the drill collar 31. Bypass element 61 may also include a conically shaped interface 64 to receive a drop ball.

Each of the plurality of chokes 50 and corresponding choke seats 40 may be disposed within the choke housing 33 at select distances from one another. For example, a choke may be disposed about nine inches from a preceding choke. According to some embodiments, a choke may be disposed less than nine inches from a preceding choke. One of ordinary skill in the art will understand that the above example is not intended to limit the scope of the invention. According to one embodiment, each of the plurality of chokes 50 may be substantially conically shaped, and each corresponding choke seat 40 is similarly shaped to receive each of the plurality of chokes 50. Thus, the plurality of chokes 50 may operate between a fully open and fully closed position, wherein the fully closed position corresponds to the plurality of chokes disposed flush against (i.e., seated in) the corresponding choke seat 40, thereby preventing bypass fluid flow. The space formed between the plurality of chokes and the choke seats form the inner cavity 36 of the flow diverter.

According to embodiments of the present disclosure, the plurality of chokes 50 may be partially open during operation. The ability to operate between varying degrees of opening allows the flow diverter 16 versatility in the amount of flow restriction through the inner cavity 36. For example, if more fluid restriction to increase the BHA flow is desired in the inner cavity 36, the piston 23 of the actuation device 20 may be moved to partially close the plurality of chokes 50, thereby decreasing the corresponding area of each choke throat.

Each of the plurality of chokes in the present example may be substantially conically shaped, although the shape of one or more chokes is not a limit on the scope of the present disclosure. For example, each of the plurality of chokes 50 may be configured such that a base of the conically shaped choke is located up-hole relative to a narrower tip of the conically shaped choke. Each of the plurality of chokes may be disposed longitudinally from a preceding choke, such that a first choke (e.g., 35) is longitudinally disposed at a selected distance from a second choke (e.g., 37). The plurality of chokes 50 may be concentric with the choke housing 33. When the plurality of chokes 50 is closed, fluid may not be permitted to flow through the choke housing 33, such that substantially all of the flow is directed through the outer cavity 34 toward the BHA. According to some embodiments the plurality of chokes may be operated together.

The flow diverter 16 may also include at least one fluid channel 38 that extends from the interior of the choke housing 33 proximate a lower end of the choke housing 33 through the wall of the drill collar 31. The at least one fluid channel 38 is configured to direct the first portion of fluid through the wall of the choke housing 33 and flow diverter to exit the drill collar 31 as bypass flow. When the plurality of chokes 50 is opened, fluid may flow through the inner cavity 36 and at least one fluid channel 38 extending through the wall of the drill collar 31 to the annulus, thus establishing the bypass flow.

Referring to FIG. 2, simultaneous operation of a plurality of chokes may be obtained by connecting each choke 50 to an operating rod 39. Having a plurality of chokes sequentially disposed within the choke housing 33 may control the flow rate of the bypass flow before it reaches the borehole annulus. This control may be achieved by ensuring an adequate pressure drop along the sequentially disposed chokes, thereby ensuring adequate dissipation of hydraulic energy of the bypass flow through the choke housing 33. This reduction of hydraulic energy of the bypass flow reduces the risk of damage to the bore hole as the diverted fluid leaves the flow diverter 16 at relatively low pressure into the bore hole annulus. As previously explained, if fluid flows along the drill string 14 in the bore hole annulus with too much pressure or at too high of a velocity, the fluid may cause damage to the bore hole by erosion of the formation surrounding the bore hole.

The flow diverter 16 may also include one or more springs. According to some embodiments, a single spring may be used to open and close the plurality of chokes 50 if the chokes are interconnected by, for example, an operating rod 39. One having ordinary skill in the art will appreciate that the single spring may be disposed at either end of the one or more chokes. According to another embodiment, the spring may be disposed longitudinally between sequentially connected chokes when more than one choke is used.

Figure 3:
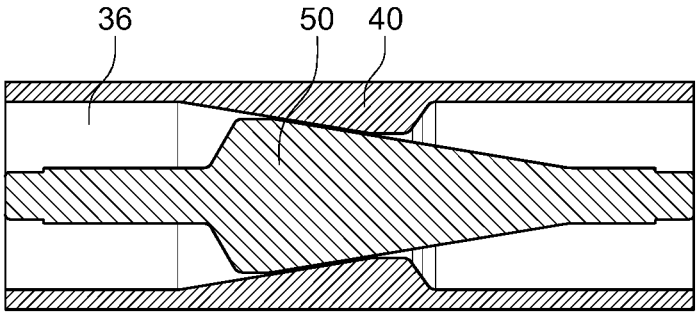
FIG. 3 shows one of the chokes in FIG. 2 in a closed position in accordance with embodiments of the present disclosure.
Figure 4:
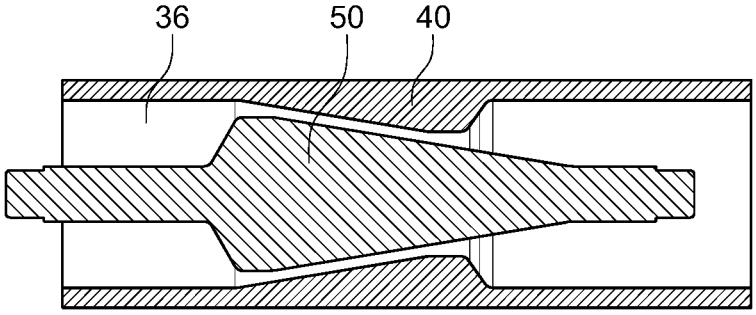
FIG. 4 shows the choke in FIG. 3 partially opened in accordance with embodiments of the present disclosure.
Figure 5:
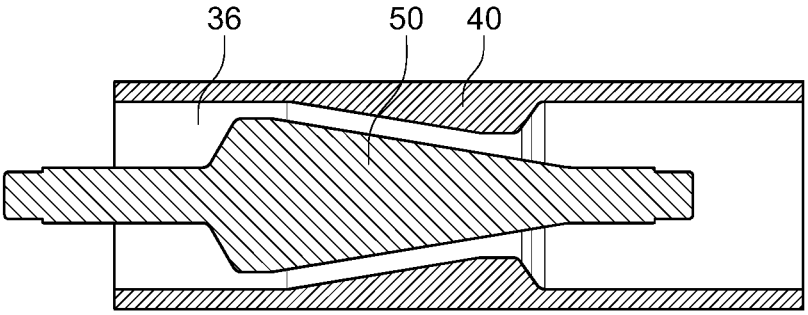
FIG. 5 shows the choke in FIG. 3 more open than in FIG. 4 in accordance with embodiments of the present disclosure.

Referring to FIGS. 3-5, according to embodiments of the present disclosure, the plurality of chokes 50 may be partially open during operation. FIGS. 3-5 show cross sectional views of one of the plurality of chokes 50 with respect to its corresponding seat 40. FIG. 3 shows the choke in a closed position. FIG. 4 shows the choke in a partially open position. FIG. 5 shows the choke in a fully open position. The ability to operate between varying degrees of opening allows the flow diverter 30 versatility in the amount of flow restriction through the inner cavity 36. For example, initially, choke 50 may be in the position shown in FIG. 5. If more fluid restriction to increase the BHA flow is desired in the inner cavity 36, the choke 50 may be moved to a partially closed position shown in FIG. 4, thereby decreasing the corresponding cross-sectional area of each choke throat. It should be noted that because of the relatively small cross-sectional area between the choke 50 and its seat 40, even in the fully open position (FIG. 5), the choke 50 may provide resistance to fluid flow there through.

Figure 6:
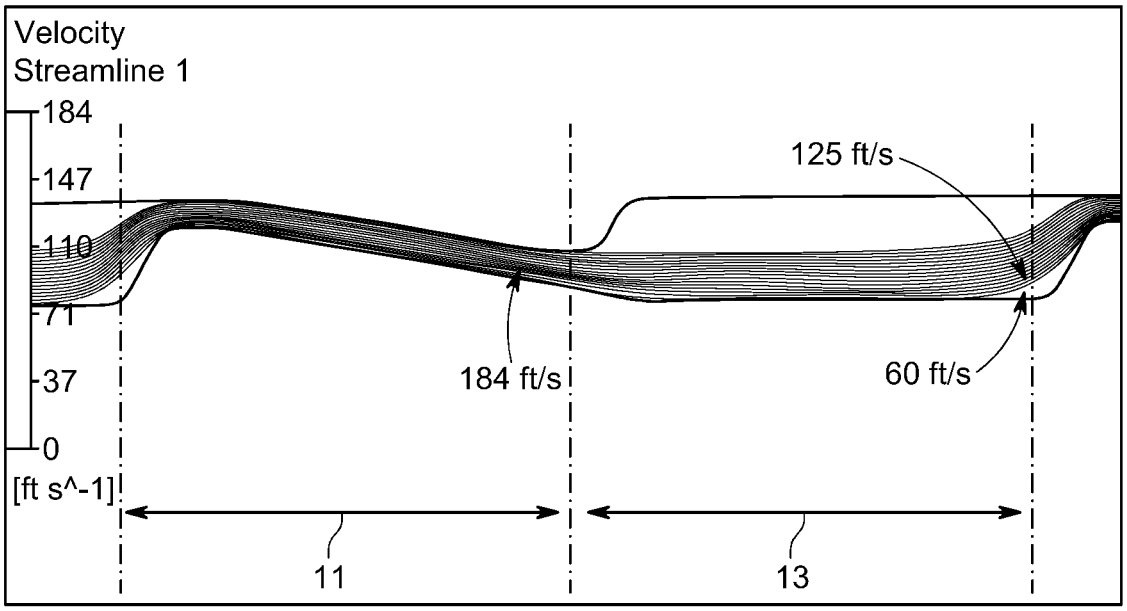
FIG. 6 shows a diagram of mud velocity through two successive chokes.

Referring to the graph in FIG. 6, at each of the one or more chokes in the by-pass flow, higher fluid velocity is generated by conversion of the potential energy of fluid pressure into kinetic energy. This is shown at 11 in FIG. 6. Across an individual choke, the following relationships apply:

$$\Delta P = K\rho V^2 \text{ and}$$

$$Q = AV$$

in which ΔP represents pressure differential across the choke, K is a constant related to the choke shape, ρ represents the fluid density, V represents the fluid velocity at the throat of the choke's nozzle, Q represents the fluid flow rate across the choke, and A represents the choke nozzle throat cross-sectional area.

The kinetic energy imparted to the fluid flow by each of the one or more chokes at the exit thereof may be dissipated by turbulence and viscosity effects. Energy dissipation may occur after each choke (and before the next choke) and also partially inside the choke itself. Enough longitudinal distance between successive chokes should be provided to allow substantial kinetic energy dissipation. This is shown at 13 in FIG. 6. Some energy dissipation occurs in the choke itself by viscous effect. This energy dissipation is internal to the choke.

Diagrams such as the one shown in FIG. 6 may be generated by computer modeling, for example, using a program such as one sold under the trademark FLOW-3D, which is a registered trademark of Flow Science, Inc., 683 Harkle Road, Suite A, Santa Fe, N. Mex. 87505. By modeling the structure of the one or more chokes and the longitudinal distance between them, it may be determined whether the choke sizes, openings, configurations and longitudinal distances between them will provide sufficient reduction in fluid flow energy, while ensuring that none of the chokes is subjected to excessive fluid flow velocity.

In addition to calculating the fluid flow velocity and fluid flow energy, the pressure drop (ΔPc) resulting from one choke may be calculated by the expression:

$$\Delta Pc = \Delta Pt/N$$

wherein ΔPt represents the total differential pressure across the drill collar wall at the position of fluid channel 38 (FIG. 2), and N represents the total number of sequentially disposed chokes in the choke housing 33 (FIG. 2).

When using a plurality of chokes and a plurality of seats, the pressure required for a particular by-pass flow rate to pass through the chokes is N times the pressure needed for the same fluid flow rate through one choke (with N being the number of chokes and choke seats). The usage of the foregoing choke with substantially cylindrical shape similarly shaped choke seats may substantially simplify the manufacture of these parts. For example, the components may be manufactured without closely matched tolerances between the N chokes and N choke seats.

Figure 7:
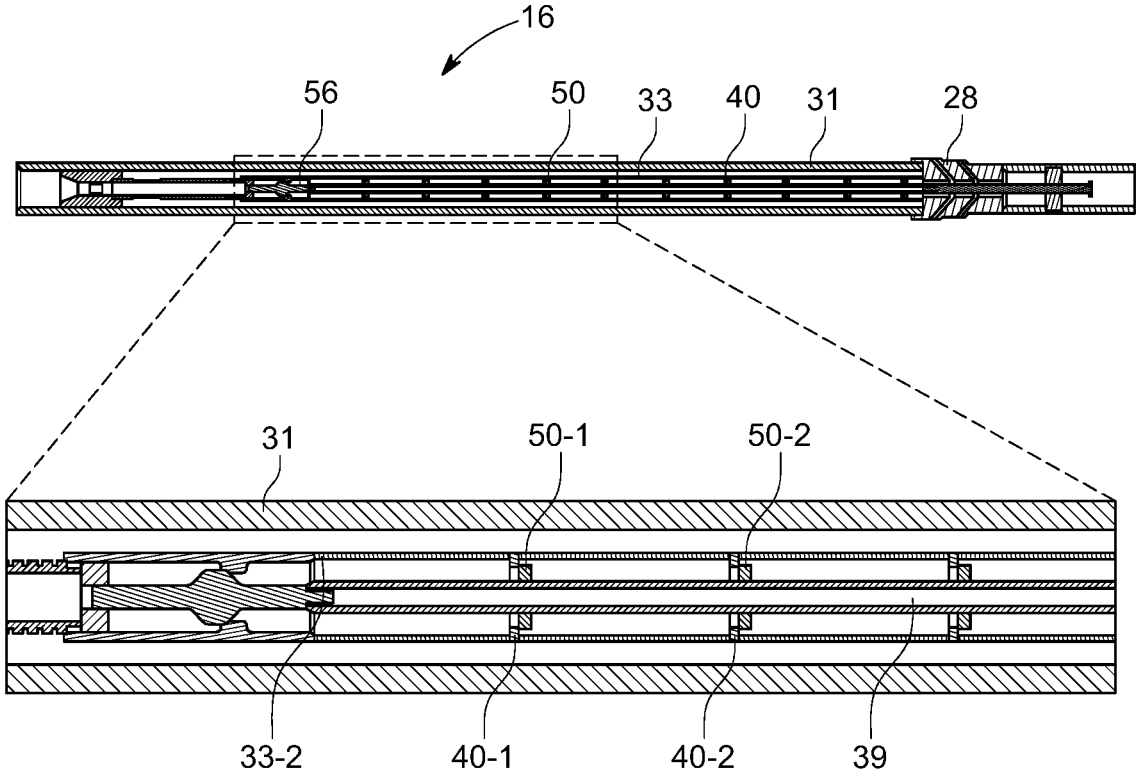
FIG. 7 shows a cross-sectional view of a flow diverter in accordance with embodiments of the present disclosure.

According to another aspect of this disclosure, various geometries of the choke and choke seat may be implemented. Referring to FIG. 7, in one embodiment, the flow diverter 16 may include a plurality of chokes 50 each formed as a disk moving longitudinally with respect to a plurality of corresponding choke seats 40 to open and close the flow restriction. As described with respect to FIG. 2, the flow diverter 16 may include a substantially cylindrical drill collar 31 having a substantially cylindrical choke housing 33 concentrically disposed within the drill collar 31. The concentricity of the foregoing components is not required, but may simplify construction of the flow diverter.

Referring to FIG. 7, the flow diverter 16 may include a plurality of adjustable chokes 50 disposed within the choke housing 33. Each of the plurality of chokes 50 may be coupled to an operating rod 39, as described with respect to FIG. 2. As shown in FIG. 7, a first choke 50-1 may be longitudinally spaced from a second choke 50-2, such that an appropriate distance is maintained between the first choke and the second choke. According to some embodiments, an appropriate distance may be for example 5-10 inches. As explained with reference to FIG. 6, the distance between successive chokes should be selected such that increased velocity imparted by each choke is dissipated before reaching the successive choke.

Continuing with the expanded portion of FIG. 7, the choke housing 33 may include a plurality of choke seats, for example 40-1 and 40-2, such that each choke 50-1 and 50-2 has a corresponding choke seat. Each of the choke seats 40-1, 40-2 may have a substantially cylindrical shape with an internal bore of a selected length, represented by "s" (see FIGS. 11-16). An inside diameter of a first choke seat 40-1 may be substantially equal to the outside diameter of the first choke 50-1, allowing the choke 50-1 to pass through the choke seat 40-1 and then continue longitudinal movement out of the choke seat 40-1.

Referring back to FIG. 7, in accordance with embodiments of the present disclosure, the flow diverter 16 as shown in FIG. 7 may include a master valve 56. A bypass element 53 may be disposed within the drill collar 31 above the choke housing 33. The bypass element 53 may comprise a plurality of openings 51 in a radial wall of the bypass element.

According to some embodiments, the bypass element 53 may be in a closed position or an open position. The closed position may be defined as when the plurality of openings 51 in the bypass element 53 is sealed from fluid communication with the outer cavity 24 by longitudinal movement of an inner tubular member, "ball drop tube" 54. The ball drop tube 54 may be actuated by longitudinal movement of the operating rod 39. The ball drop tube 54 is moved axially upward to a position radially inward of the openings 51 of the bypass element 53 to restrict or prevent fluid flow from inside the ball drop tube 52 to the outer cavity 24, and therefore to the BHA. The open position is defined as when fluid communication from the bypass element 53 and outer cavity 24 is allowed, i.e., when the plurality of openings 51 of the bypass element 56 are unobstructed. For example, as shown in FIG. 7, the ball drop tube 54 is disposed axially below the openings 51 of the bypass element 53 in the open position. Thus, in the open position, the second portion of the fluid flowing through the bypass element 53 is enabled to move into the outer cavity 24.

Figure 8:
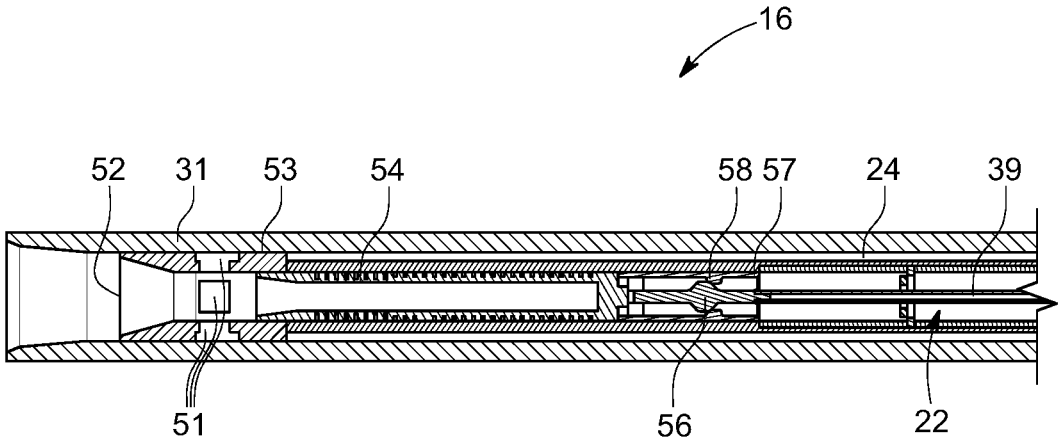
FIG. 8 shows a portion of a flow diverter in accordance with embodiments of the present disclosure.

As shown in FIG. 7, the first portion of the fluid flow may pass through the center 52 of the bypass element 53 into a ball drop tube 54 and continue to a master valve 56 (shown in closed position in FIG. 8) and then into the choke housing 33. As shown in FIG. 8, the master valve 56 is disposed at an uphole end of the choke housing 33. The master valve 56 may be disposed within a master valve housing 57. The master valve housing 57 may comprise a master valve seat 58, such that when the master valve 56 is in a closed position, fluid is restricted or prevented from flowing through the master valve housing 57. The master valve 56 provides positive blockage of fluid flow into the choke housing 33. The master valve 56 may be constructed, for example, in a similar configuration as valves used in a positive displacement drilling fluid pump, including an elastomer seal (not shown) for providing positive flow blockage.

The master valve 56 may be coupled to the operating rod 39, described above, so as to move simultaneously with the one or more chokes. As configured, the master valve 56 may be fully opened while the plurality of chokes 50 are still in the closed position (or at a minimum flow position). For example, the master valve 56 may be opened while the plurality of chokes 50 are fully engaged (i.e. displaced from 0 to "s-t"). During long periods of use, wherein by-pass fluid flow takes place within the flow diverter 16, erosion may occur in the plurality of chokes 50 so that the minimum flow obtainable increases when the one or more chokes are fully closed. In other words, erosion to the plurality of chokes 50 or the corresponding plurality of choke seats 40 may permit a flow of fluid even when the plurality of chokes 50 is in a fully closed position. The master valve 56 may be closed in such conditions to ensure zero by-pass flow through the choke housing 33 when such by-pass flow is not desired. The cylindrical chokes described with reference to FIG. 7 enable full closure of the master valve 56 because a choke seating length (i.e. the length of longitudinal movement of the choke through its seat while remaining closed or at minimum flow rate) may be longer than the required longitudinal movement for opening or closing the master valve 56. However, one having ordinary skill in the art would understand that the geometry of the plurality of chokes is not intended to limit the scope of the application of a master valve.

The plurality of chokes 50 and the master valve 56 may be operatively coupled to an operating rod 39, which may be actuated by an actuation system having a piston as shown at 34 in FIG. 2. The piston 34 may generate enough force to longitudinally move the chokes. Movement of the piston 34 may be induced by various drive systems such as hydraulic jacks or screw and ball nut systems. The drive system can be activated by a control unit, for example, a control unit disposed in one of the MWD/LWD tools (15 in FIG. 1) capable of decoding a command transmitted from the surface.

Longitudinal movement of the plurality of chokes 50 will now be explained with reference to FIGS. 10-16. FIGS. 10-15 show cross-sectional views of a choke 50-1 and its axial movement relative to a corresponding choke seat 40-1. FIG. 15 shows a graph illustrating the dependence of the flow rate through the choke 50-1 with respect to the choke position (x) for a given constant differential pressure across the plurality of chokes. The length of the choke seat 40-1 is "s"; the thickness of the choke 50-1 is "t." The axial displacement of the choke is determined by the variable x. The reference "0" of the x axis corresponds to the case shown in FIG. 8.

Figure 9:
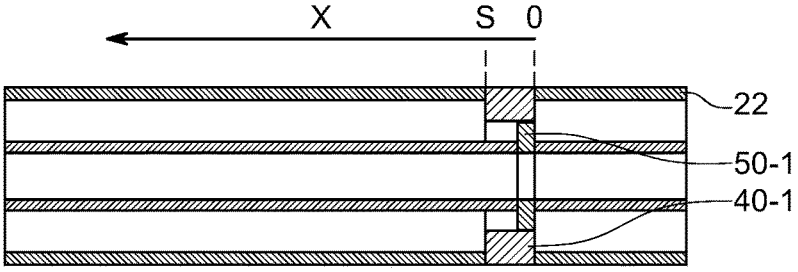
FIGS. 9-14 illustrate movement of a choke in accordance with embodiments of the present disclosure.
Figure 10:
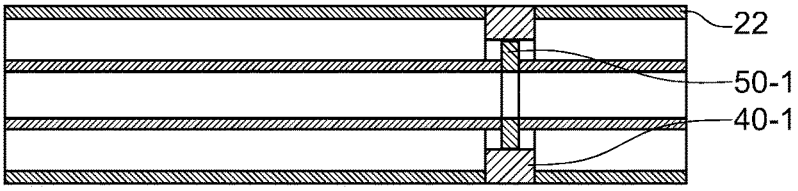
Figure 11:
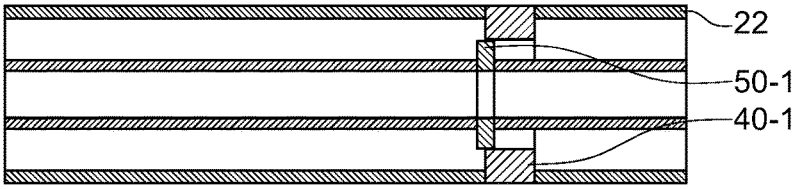
Figure 12:
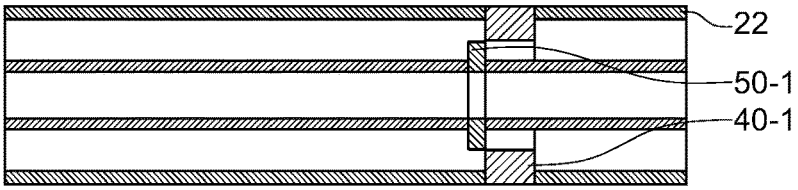

Referring to FIG. 9-14, cylindrical choke 50-1 is shown in the choke housing 33 with respect to its position in the choke seat 40-1. In FIG. 9, the choke 50-1 is at longitudinal position (x) corresponding to zero. In FIG. 10, the choke 50-1 has been displaced, but is still within the choke seat 40-1, in other words the choke 50-1 has not been longitudinally displaced an axial distance greater than the length of choke seat 40-1 "s." In FIG. 11, the choke 50-1 has been longitudinally displaced near the end of the choke seat 40-1, by a distance slightly less than "s." When the choke is fully inserted in the choke seat (i.e. choke is displaced by less than "s-t") the fluid flow flows within the clearance between the choke seat 40-1 and the choke 50-1. Thus, the by-pass flow stays at a nearly constant flow rate of $Q_{min}$, where $Q_{min}$ is very low or nearly zero, as shown in FIG. 11.

As the choke 50-1 continues its axial displacement between "s-t" (FIG. 12) to "s" (FIG. 13), the length of the choke 50-1 that overlaps the choke seat 40-1 decreases. When the displacement of the choke is larger than "s-t", the choke 50-1 disengages partially from the choke seat 40-1. In this condition, the by-pass flow increases nearly linearly with the axial displacement x as shown in FIG. 13.

Figure 13:
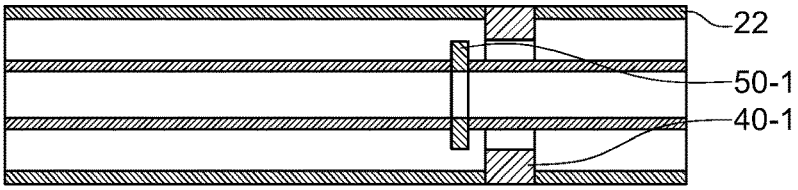
Figure 14:
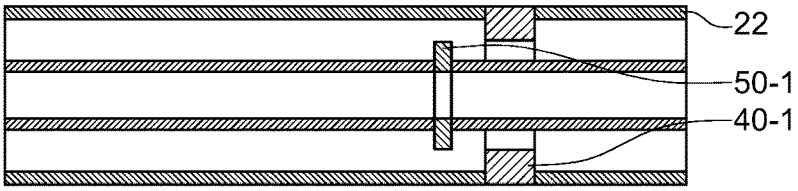
Figure 15:
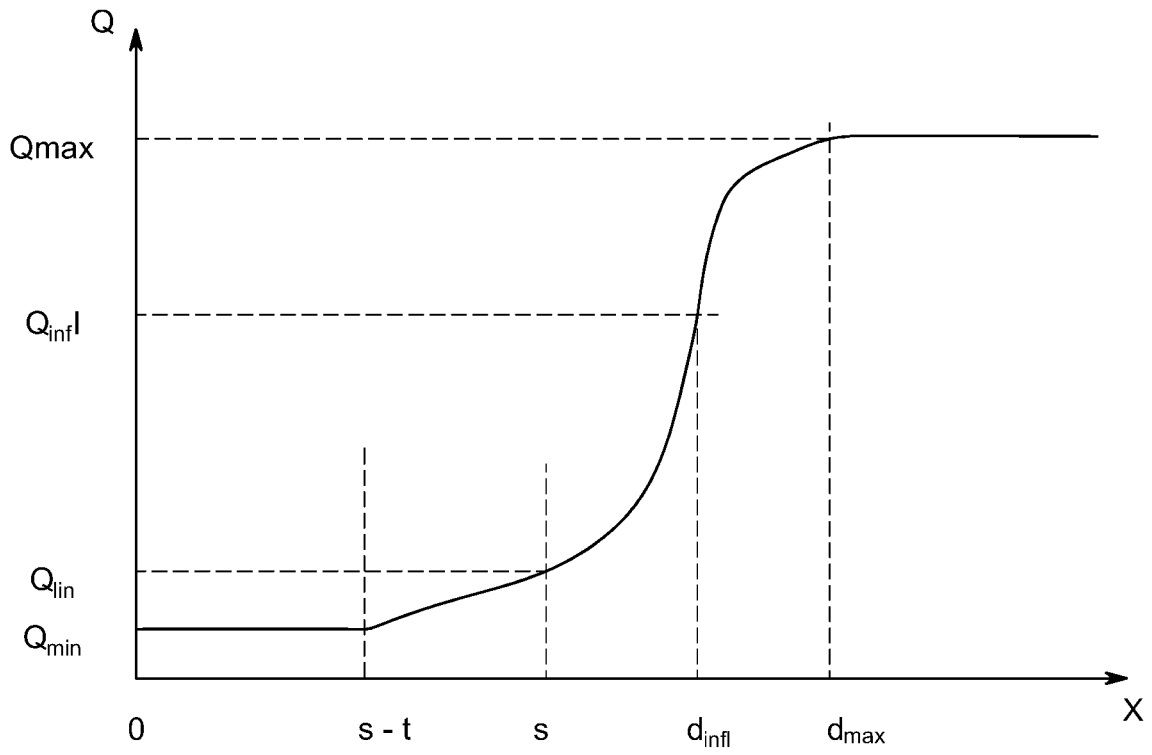
FIG. 15 shows a graph of flow rate through a choke of a flow diverter in accordance with embodiments of the present disclosure.

For choke displacement larger than s, as seen in FIGS. 13 and 14, the choke is substantially disengaged from the choke seat. Referring to FIG. 13, the choke 50-1 is located in a position corresponding to "$d_{infl}$" illustrated in the plot of FIG. 15. As seen in FIG. 15, "$d_{infl}$" is located at the inflection point in the plot, where the effect of increased displacement on bypass flow begins to diminish, slowly at first and then more quickly as the displacement approaches "$d_{max}$." When the choke displacement reaches the maximum axial displacement allowed, that is, the position "$d_{max}$," represented by the position shown in FIG. 14, any additional displacement increase has nearly no effect on the by-pass flow.

Figure 16:
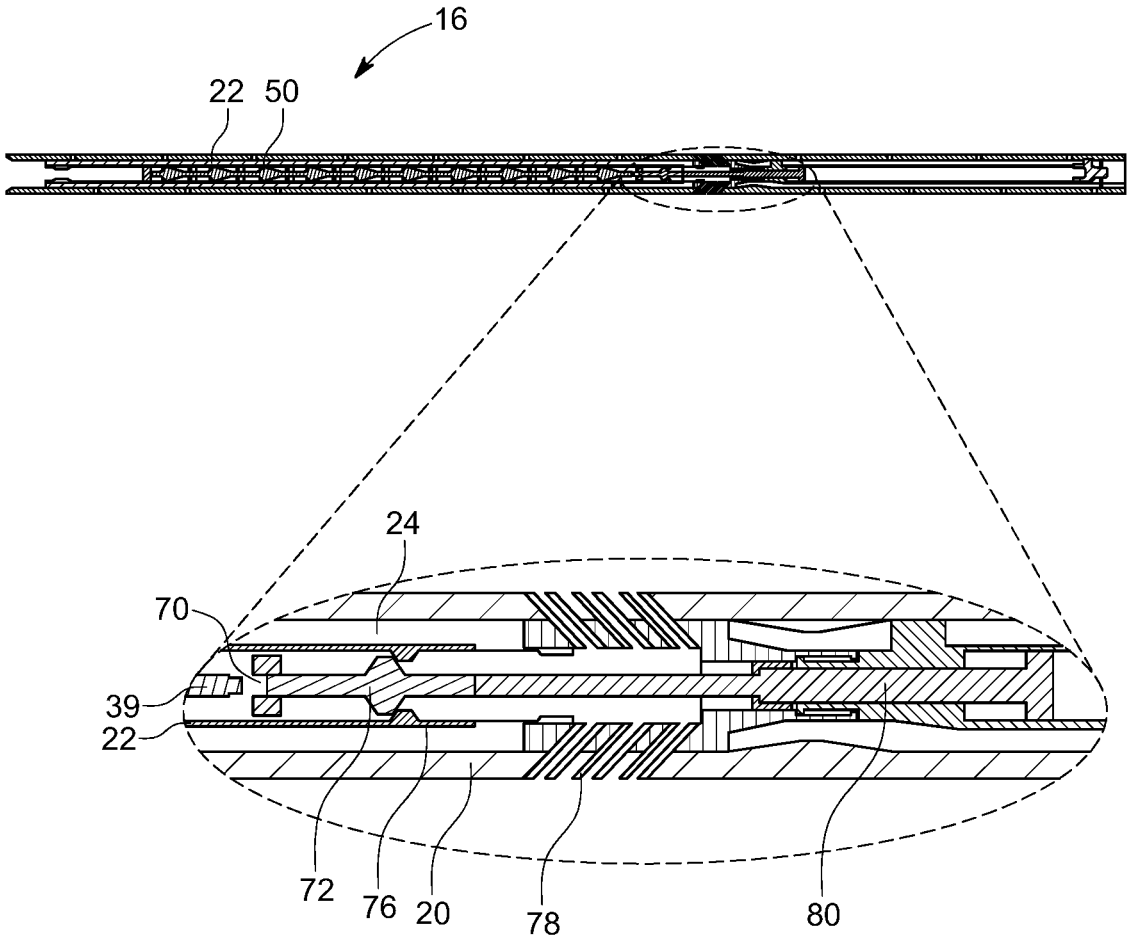
FIG. 16 shows cross-section of a flow diverter in accordance with embodiments of the present disclosure.

According to another embodiment of the present disclosure, the master valve may be located downhole from the choke housing 33. Referring to FIG. 16, a cross sectional view of a flow diverter 16 with conical chokes having master valve 72 is disposed proximate the bottom of the choke housing 33. As described above with respect to FIG. 2, the drill collar 31 may include a plurality of fluid channels 78 in fluid communication with the borehole annulus 12. FIG. 16 also shows a magnified cross section of the master valve 72. A master valve housing 76 may be disposed concentrically within the drill collar 31. The master valve 72 may be disposed within the master valve housing 76 proximate a downhole end of a choke housing 33.

Referring to FIGS. 2, 3, and 17-19, according to embodiments of the present disclosure, a piston 34, 80 may be operatively coupled to the plurality of chokes 50 by, for example, operating rod 39. The piston 34, 80 actuates the plurality of chokes 50 from the closed position to selected open positions. The piston 34, 80 may be moved by an actuator system 9. The actuator system may comprise a hydraulic cylinder and pump, with suitable valving to move the piston 34 in a selected direction. According to some embodiments, the piston may be operatively coupled to and actuated by a biasing mechanism and a valve system (i.e. a solenoid). According to some embodiments, the piston may be actuated by a motor coupled to a screw with a ball nut disposed on the screw and in functional contact with the piston 34, 80. The motor may be, for example, an electric motor or a hydraulic motor. The actuator system 9 may be operated by certain components of the MWD/LWD system (15 in FIG. 1) in response to commands sent, for example, by modulation of pressure and/or flow of fluid through the drill string (14 in FIG. 1). One having ordinary skill in the art will understand that the actuation system is not intended to limit the scope of the present application.

Figure 17:
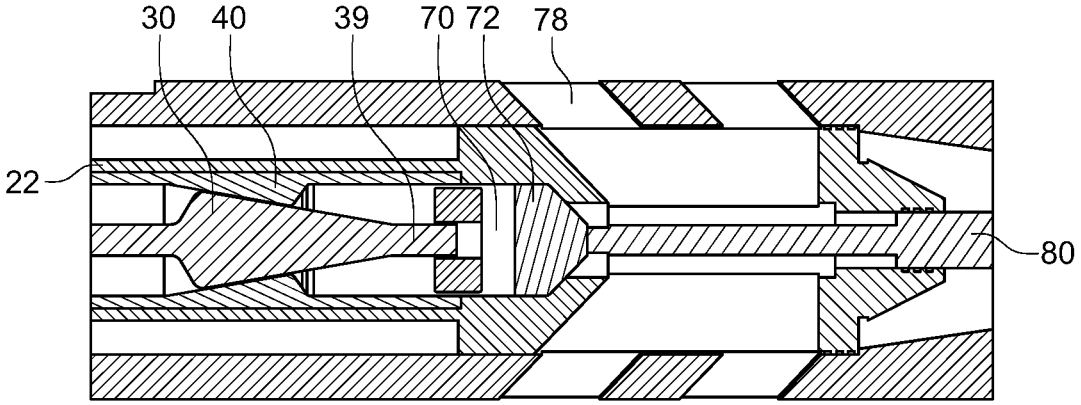
FIGS. 17-19 illustrates interaction between piston and chokes in accordance with embodiments of the present disclosure.
Figure 18:
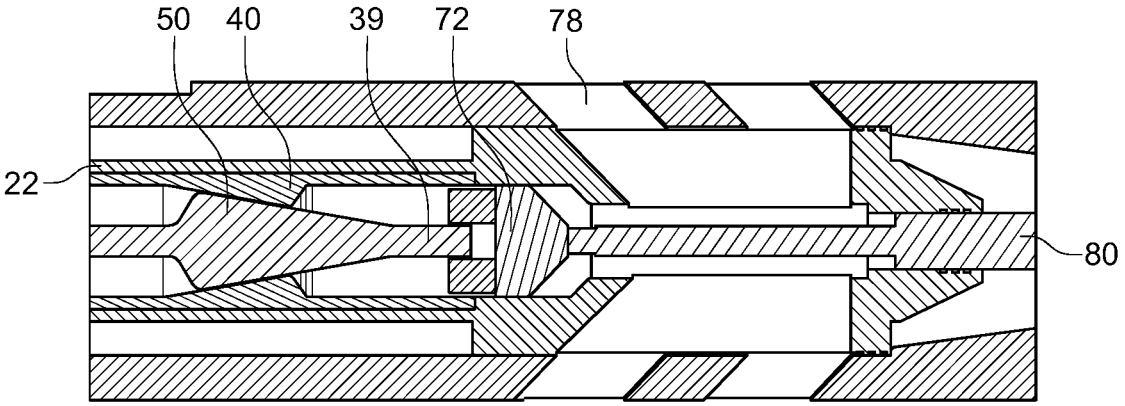
Figure 19:
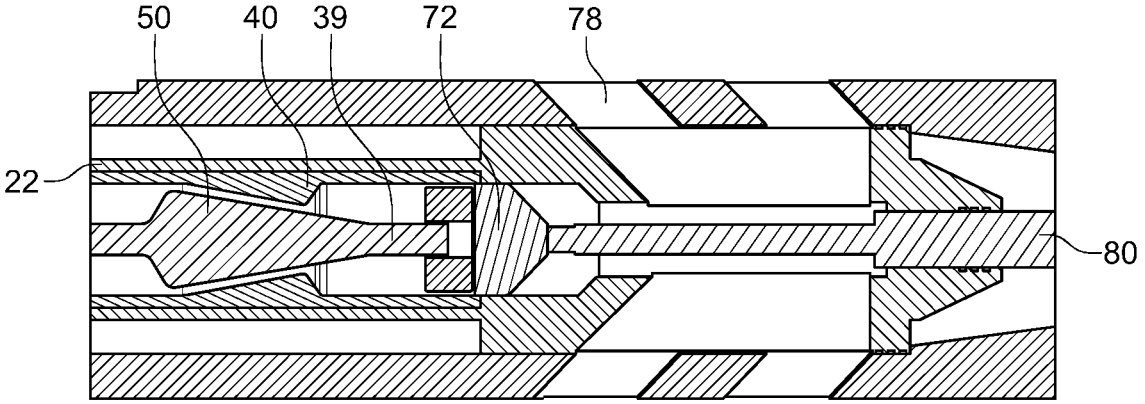

Referring to FIGS. 17-19, the actuation of the chokes will be explained in greater detail. According to embodiments of the present disclosure, a piston 80 may be disposed adjacent the master valve 72. As described above, the piston 80 may be actuated by any actuating means known in the art, for example, various drive systems such as hydraulic jacks, screw and ball nut systems, or biasing mechanisms and solenoids. The piston 80 causes master valve 72 to move upward to an open position. The piston 80 may be cond to move the master valve 72 between the closed position and the open position. The open position is defined as when fluid can flow between the master valve 72 and the master valve housing 76. The closed position is defined as when fluid cannot flow between the master valve 72 and the master valve housing 76. FIG. 17 shows the master valve 72 in the closed position.

Referring to FIG. 17, the master valve 72 is shown in a closed position. A gap 70 may separate the master valve 72 from the operating rod 39 while the master valve 72 is in the closed position. The gap 70 may be maintained between the master valve 72 and the operating rod 39 when the master valve 72 is in the closed position to assure that the plurality of chokes 50 are not actuated before the master valve 72 is in the open position. FIG. 18 shows piston 80 moved uphole towards the choke housing 33, such that the master valve 72 just contacts the end of operating rod 39, but does not apply a substantial force to the operating rod. As shown in FIG. 18, the plurality of chokes remain in the closed position.

Referring to FIG. 19, as the piston 80 is moved uphole toward the choke housing 33, after the master valve 72 has reached the open position, continued movement of the piston 80 in the direction of opening the master valve 72 may move the master valve 72 into contact with the operating rod 39 and apply a force to the operating rod. Once the piston 80 and master valve 72 are in contact with the operating rod 39, the master valve 72 will then move operating rod 39 axially upward, which will open the plurality of chokes (e.g., 50 in FIG. 16) coupled to the operating rod 39.

Referring again to FIG. 8, in the event that the actuation system fails, a "ball drop" system may be implemented as recovery feature to close the flow diverter so that no fluid flows to the borehole annulus, i.e., there is no by-pass flow. Ball drop tube 54 may include a conically shaped internal feature 53 to act as a recovery feature and accommodate a ball (not shown). A ball (not shown) may be dropped in the drill-string by the operator form the surface. The ball moves downwardly due to gravity and hydraulic drag when fluid flow is present. When the ball reaches the flow diverter 16, it seats within the conically shaped internal feature 53 at the top of the ball drop tube 54. The ball may block the fluid flow into the choke housing 33 by its presence in the ball drop tube 54, while still allowing fluid to flow into through opening 51 to provide BHA flow. According to some embodiments, the fluid pressure acting on the ball may cause axial movement of the ball drop tube 54, the master valve 56, 72 and the operating rod 39. The downward movement closes the fluid flow path to the borehole annulus through the choke housing 33 by closing the mater valve 56 and the plurality of chokes 30 coupled to the operating rod 39. One having ordinary skill in the art will understand that a similar ball drop system may be present for conically shaped plurality of chokes as presented in FIG. 2.

Figure 20:
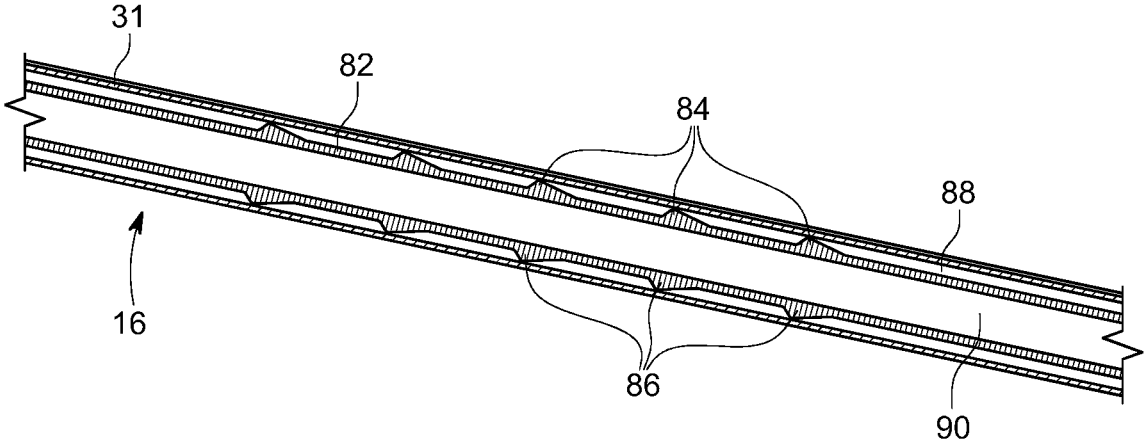
FIG. 20 shows a flow diverter in accordance with embodiments of the present disclosure.

Referring to FIG. 20 another embodiment of the flow diverter 16 is shown. The flow diverter of FIG. 20 includes a plurality of chokes 84 and a corresponding plurality of choke seats 86. The plurality of chokes 84 and the plurality of choke seats 86 are disposed in an annulus located between a tube 90 and the drill collar 31. The plurality of chokes 84 may be affixed to a sleeve 82 and configured to move axially within an annular space 88, where the annular space is located between the drill collar 31 and sleeve 82.

The sleeve 82 may be moved axially to move the plurality of chokes 84 between a fully open and a fully closed position. In the fully closed position, the plurality of chokes 84 may each be seated in the corresponding choke seat 86 such that no fluid flow or limited fluid flow is permitted through annular space 88. The sleeve 82 may be actuated in a manner similar to that of operating rod 39, as described above. According to the embodiment of FIG. 20, the first portion of fluid flow (i.e. bypass fluid flow) is directed to flow in the annular space 88, while the second portion of fluid flow (i.e. BHA flow) flows through the center of the flow diverter 16, i.e., through tube 90.

The annular choke flow diverter 16 may be built with conically shaped chokes, as shown in FIG. 20. One having ordinary skill in the art will understand that the flow diverter 16 may also be built having disk shaped (i.e., annular ring shaped) chokes and choke seats similar to the chokes described in FIG. 7. For an annular ring shaped choke (not shown), the choke seat may be attached to the interior wall of the drill collar, while the annular disk choke(s) may be affixed to the exterior of the sleeve 82. An example actuator that may be used to move the sleeve 82 is explained with reference to FIG. 21.

Figure 21:
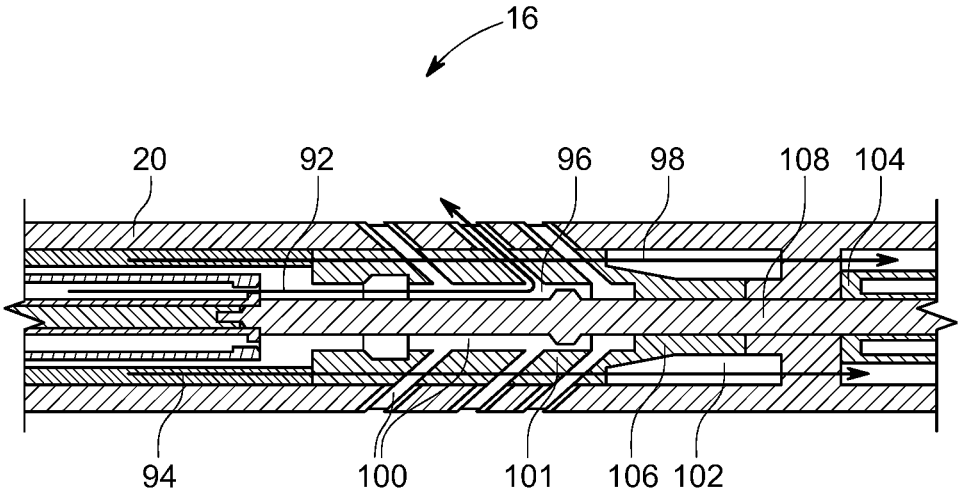
FIG. 21 shows a portion of a flow diverter in more detail in accordance with embodiments of the present disclosure.

FIG. 21 shows a flow diverter 16 having a substantially cylindrically shaped sleeve housing 98 disposed within the drill collar 31, such that the sleeve housing 98 is sealed to the drill collar 31. A substantially cylindrically shaped sleeve 101 may be disposed within the sleeve housing 98, such that the sleeve 101 is sealed to the sleeve housing 98 while also configured to move axially relative to the sleeve housing 98. The drill collar 31, sleeve housing 98, and sleeve 101 each contain a plurality of corresponding fluid channels 100. The sleeve 101 may move longitudinally between an open position and a closed position, wherein the open position corresponds to alignment of the flow channels 100 in the drill collar 31, sleeve housing 98, and sleeve 101.

During fluid flow, when the sleeve 101 is in an open position, the first portion of fluid flow 92 passes through the flow channels 100 to reach the borehole annulus (12 in FIG. 1). The second portion of fluid flow 94 passes around the circumferential segments of sleeve housing 98 and flows down toward the BHA. When there is no fluid flowing through the flow diverter 16 (i.e. such there is no by-pass flow) debris may accumulate in the borehole annulus and obstruct the flow channels 100 in the drill collar 31 and sleeve housing 98. To prevent debris from obstructing the flow channels 100, the sleeve 101 may be moved longitudinally to a closed position, thereby sealing off the flow channels 100.

The flow diverter 16 shown in FIG. 21 may also include a piston 108 and a piston housing 104 disposed proximate the sleeve housing 98. A primary piston 108 may be disposed in the piston housing 104. According to some embodiments, the primary piston 108 may be used to actuate one or more chokes. The primary piston 108 may also be used to actuate the sleeve 101 from the closed position to the open position. For example, according to some embodiments, the primary piston 108 and the sleeve may be mechanically coupled together, by for example, threaded engagement, bolted engagement, fasteners, etc. A secondary piston 106 may be disposed in the sleeve housing 98 proximate the sleeve 101. The secondary piston 106 may be used to actuate the sleeve 101 and the one or more chokes. According to some embodiments, a plurality of pistons as shown in FIG. 21, may actuate the sleeve 101 and the choke(s) because, for example, the pressure needed for the actuation may be too great for a single piston. According to embodiments having multiple pistons, the secondary piston 106 will prevent too much thrust being applied to the primary piston 108.

Figure 22:
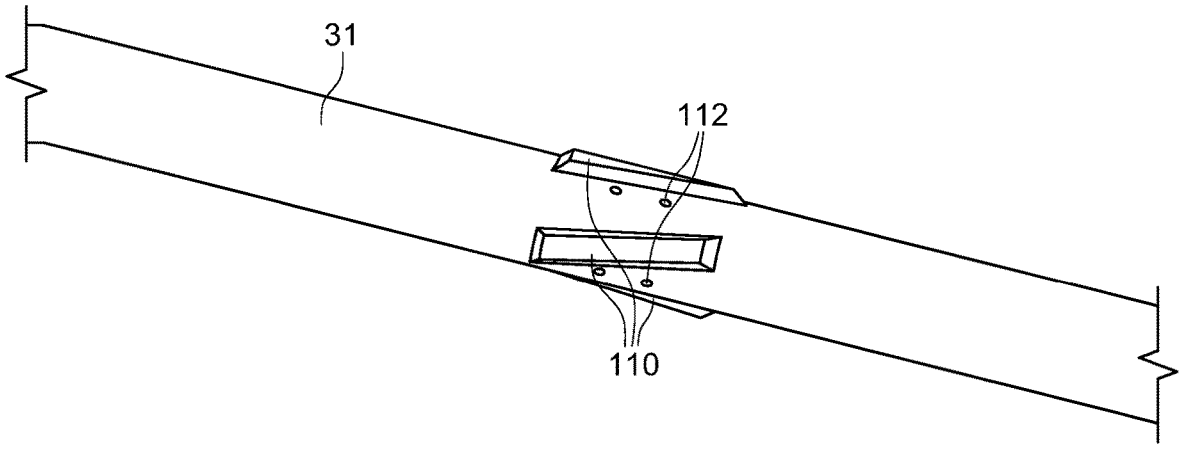
FIG. 22 shows an external view of a flow diverter in accordance with embodiments of the present disclosure.

Referring to FIG. 22, an external view of a flow diverter is shown. According to some embodiments, the drill collar 31 may include a plurality of stabilizer fins 110. The stabilizer fins 110 may extend outward from the drill collar 31 to a borehole wall. The plurality of stabilizer fins 110 may reduce unwanted vibration in the drill collar 31. The plurality of stabilizer fins 110 may also affect the steering capabilities of the BHA (18 in FIG. 1). The plurality of stabilizer fins 110 may also help to prevent debris from entering the plurality of fluid channels 112 by lifting the debris as it flows past the plurality of fluid channels 112 (between the stabilizer fins 110). One having ordinary skill in the art will understand, that fluid channels 112 may correspond to fluid channels 28, 78, and 100 described with respect to the previous FIGS. The internal components of a flow diverter as shown in FIG. 22 may be as any of the previously described in FIGS. 2-21.

Figure 23:
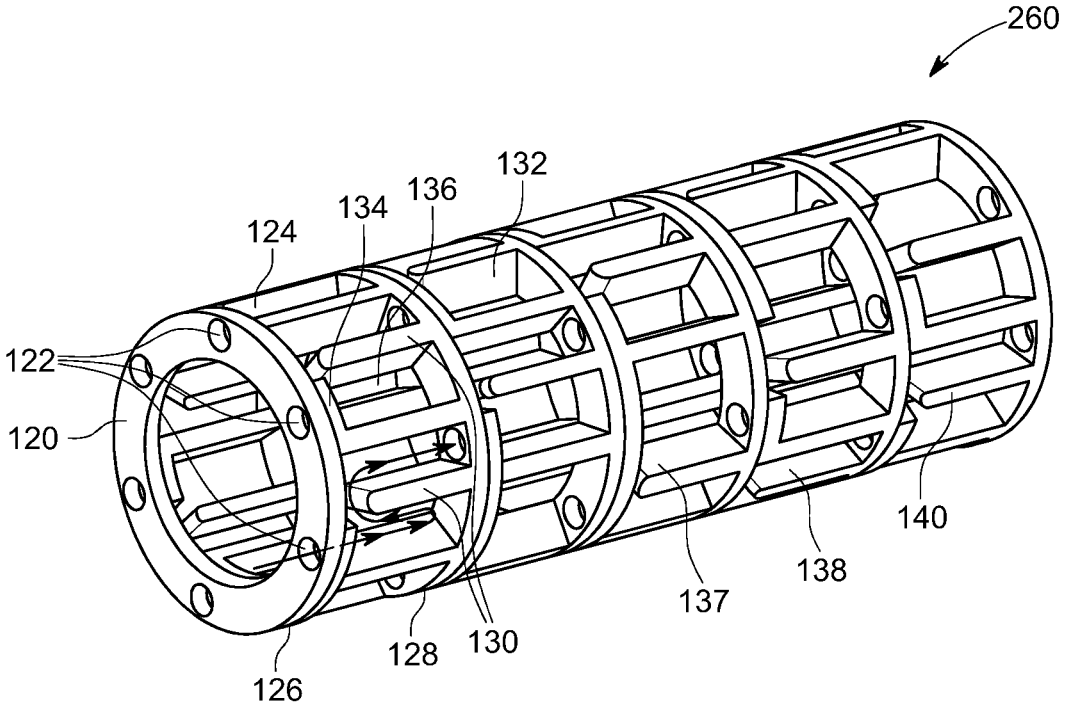
FIG. 23 shows a choke apparatus in accordance with embodiments of the present disclosure.

FIG. 23 discloses another embodiment of a flow diverter having a choke device 260. Choke device 260 includes an orifice ring 120 having a plurality of openings 122, and a plurality of segments 124, 132, 137, 138, and 140. A set of parallel first valves (not shown) may be in fluid communication with the plurality of openings 122 to control the flow there through to reach a first segment 124 of the choke device 260. The set of parallel first valves may be actuated by any form of actuator known in the art. The set of parallel first valves provides a flow of fluid to each opening 122 in the orifice ring. Each flow of fluid moves through the first segment 124 along a flow path 136. The plurality of flow paths 136 may be separated by dividers 130. For each of these flow paths 136, a static choke system (e.g., a segment with a selected size for each opening 122) dissipates energy through the plurality of openings and a tortuous flow path between a first end 126 and a second end 128 of the first segment 124. A second segment 132 of the choke device 260 may be disposed at the second end 128 of the first segment, and may be configured substantially identically to the first segment 124.

Figure 24:
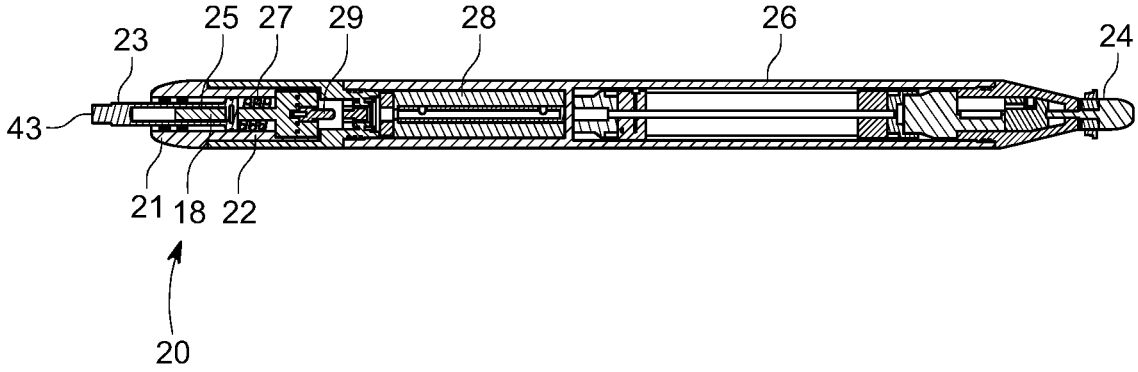
FIG. 24 illustrates an actuation system in accordance with embodiments of the present disclosure.

The flow diverter having a choke device 260 may include sequentially disposed additional segments; segments 137, 138, 140 may be disposed as shown in FIG. 24. The number of and configuration of each of the segments 124, 132, 137, 138, 140 may depend on the amount of pressure drop needed, the by-pass flow rate range needed, and the properties of the fluid, among other factors. Choke device 260 may be used, for example, in a flow diverter wherein the by-pass flow moves through an annular space (see 88 in FIG. 20) between a tube (see 90 in FIG. 20) for carrying the BHA flow and the interior wall of a drill collar (31 in FIG. 20).

Each of the segments 124, 132, 137, 138, 140 may include respective attachment surfaces 134 to contact an interior wall of the drill collar. Each of the plurality of attachment surfaces 134 may include an opening (not shown) that corresponds to a plurality of openings of a corresponding one of the first openings 122 of the orifice ring 120. As fluid travels through each of the plurality of segments, the pressure of the fluid decreases. Therefore, the greater the number of segments in the choke device 260, the greater the pressure drop in the by-pass flow. According to some embodiments, the orifice ring 120 may be rotatable with respect to the first segment 124, such that the openings 122 in the orifice ring may be selectively opened as required to adjust the amount of flow through the choke device 260. According to some embodiments, there may be another ring or set of poppet valves (not shown) for selectively allowing fluid flow through the first openings 122.

It will be appreciated by those skilled in the art that while the foregoing examples of a flow diverter include concentric flow passages, wherein the first and second flow paths (i.e., by-pass flow and BHA flow) are concentric with the drill collar, it is also within the scope of the present disclosure to have the first and second flow paths disposed within the drill collar non-concentrically. For example, the first flow path and the second flow path may be disposed in respective passageways side by side within the drill collar. Other configurations will occur to those skilled in the art.

FIG. 24 illustrates an actuation system 20 according to embodiments of the present disclosure. The actuation system 20 may include a housing 21, a piston 23 disposed within the housing 21, the piston 23 having an interior chamber 25, a spring 27 configured to bias the piston 23, and a valve assembly 29 in fluid communication with the interior chamber 25. The actuation system 20 may also include an electronics sub 28, a battery 26, and a turbine 24. Referring briefly to FIG. 2, actuation system 20 may be disposed within a drill string 14 such that an annular space is formed between the actuation system 20 and an interior of the wall of the drill string 14.

The housing 21 of actuation system 20 may be oriented such that housing 21 includes a first end and a second end, the first end disposed up-hole from the second end. Piston 23 is disposed within housing 21 such that piston 23 is configured to move axially within the housing 21. Piston 23 may include a top face 43 and a flange 22. The flange 22 may seal and abut an inner diameter of the housing 21, such that a volume beneath piston 23 is fluidly isolated from a volume up-hole of the flange 22 of the piston 23.

As shown in FIG. 1, spring 27 may be disposed downhole of piston 23. Spring 27 may be operatively coupled to piston 23 such that piston 23 is biased by spring 27 in an up-hole direction. According to some embodiments, the spring may be replaced with other biasing mechanism known in the art, for example a lead screw or ball screw coupled to a motor, a piston operatively connected to a pump, gearbox, and motor, and a piston operatively connected to a pump and motor. According to some embodiments, the piston may be driven by a differential pressure between the inner diameter of the tool and an annulus of the bore hole. In such an embodiment, at least one valve may control flow into the annulus of the bore hole and generate motion of the piston in at least one of an up-hole or downhole direction.

In accordance with the embodiment shown in FIG. 1, spring 27 may be disposed downhole of the piston 23. Spring 27 may be disposed in the volume beneath piston 23, thereby being fluidly isolated from other regions of the actuation system, i.e., above flange 22. Fluidly isolating the spring 27 may prevent drilling fluids from causing wear and erosion of spring 27. Spring 27 may be any spring for downhole use known in the art, for example, but not limited to, Belleville or coil springs. One having ordinary skill in the art will understand that the type of spring or biasing mechanism used is not a limitation on the scope of this disclosure.

Housing 21 may also include valve assembly 29 disposed at the second end of the housing 21, below the spring 27. One having ordinary skill in the art will understand that the relative positions of the piston 23, spring 27, and valve assembly 29 is not meant to limit the scope of this disclosure. As shown, the valve assembly 29 is in fluid communication with an interior chamber 25 of the piston 23. For example, the valve assembly may provide a fluid to or remove a fluid from interior chamber 25, thereby pressurizing or depressurizing the piston 23. The fluid in the interior chamber 25 may be any relatively incompressible fluid used in the art to pressurize chambers, for example, oil. The fluid is provided to interior chamber 25 via fluid line 18. In some embodiments, the valve assembly 29 may include a solenoid. Specifically, according to some embodiments, the solenoid may be a bi-directional solenoid that operates to open and close the valve assembly. In some embodiments, the valve assembly 29 may include two single-direction solenoids with a ball check valve (not shown). Thus, the valve assembly 29 may provide a means to pressurize the interior chamber 25 of piston 23 (i.e., by closing the valve assembly) as well as release pressure (i.e., by opening the valve assembly) depending on the requirements of the actuation system 20.

Referring to FIG. 24, actuation system 20 may include an electronics sub 28 and a battery 26 coupled to the downhole end of the actuation system 20. Battery 26 is operatively coupled to electronics sub 28 and actuation system 20, such that battery 26 provides power to electronics sub 28 and actuation system 20. As seen in FIG. 24, battery 26 may be disposed downhole from electronics sub 28. Electronics sub 28 includes a control module (not shown) configured to operate the actuation system 20. For example, the control module may send instructions to the valve assembly 29 to open or close the valve assembly 29. The control module may also be coupled to a plurality of sensors for measuring various downhole conditions throughout the drill string, for example, flow rate, temperature, and pressure and other downhole conditions of interest. The electronics sub 28 may be in communication with electronic modules at the surface so that the downhole conditions of the drill string may be monitored in real time. The control module may also be used to perform calibrations of the actuation system. For example, the control module may be used to perform the calibration for the turbine 24 or the sensor used to measure the axial position of the piston 23.

Actuation system 20 may also include a turbine 24. As shown in FIG. 24, turbine 24 may be disposed downhole from the electronics sub 28 and battery 26. One having ordinary skill in the art will understand that the relative location of the electronics sub 28, battery 26, and turbine 24 is not intended to limit the scope of the disclosure. The turbine 24 may be included to measure a flow rate in the annular space 15. As fluid flows in the annular space 15 between the actuation system 20 and the wall of the drill string, the fluid will flow past turbine 24. This flow of fluid will cause the turbine to rotate. The revolutions per minute (RPM) of the turbine 24 corresponds to a flow rate. For example, a higher RPM corresponds to a higher flow rate. Before operation, the turbine may be calibrated so that a measured RPM corresponds to a particular flow rate.

Other means of measuring a flow rate may be included in the downhole tool. For example, according to some embodiments, a sensor (not shown) may determine the flow rate by measuring an axial position of the piston 23 within the piston housing 21. As with the turbine 24, the sensor may be calibrated such that a specific axial location of the piston 23 corresponds to a known flow rate.

Figure 25:
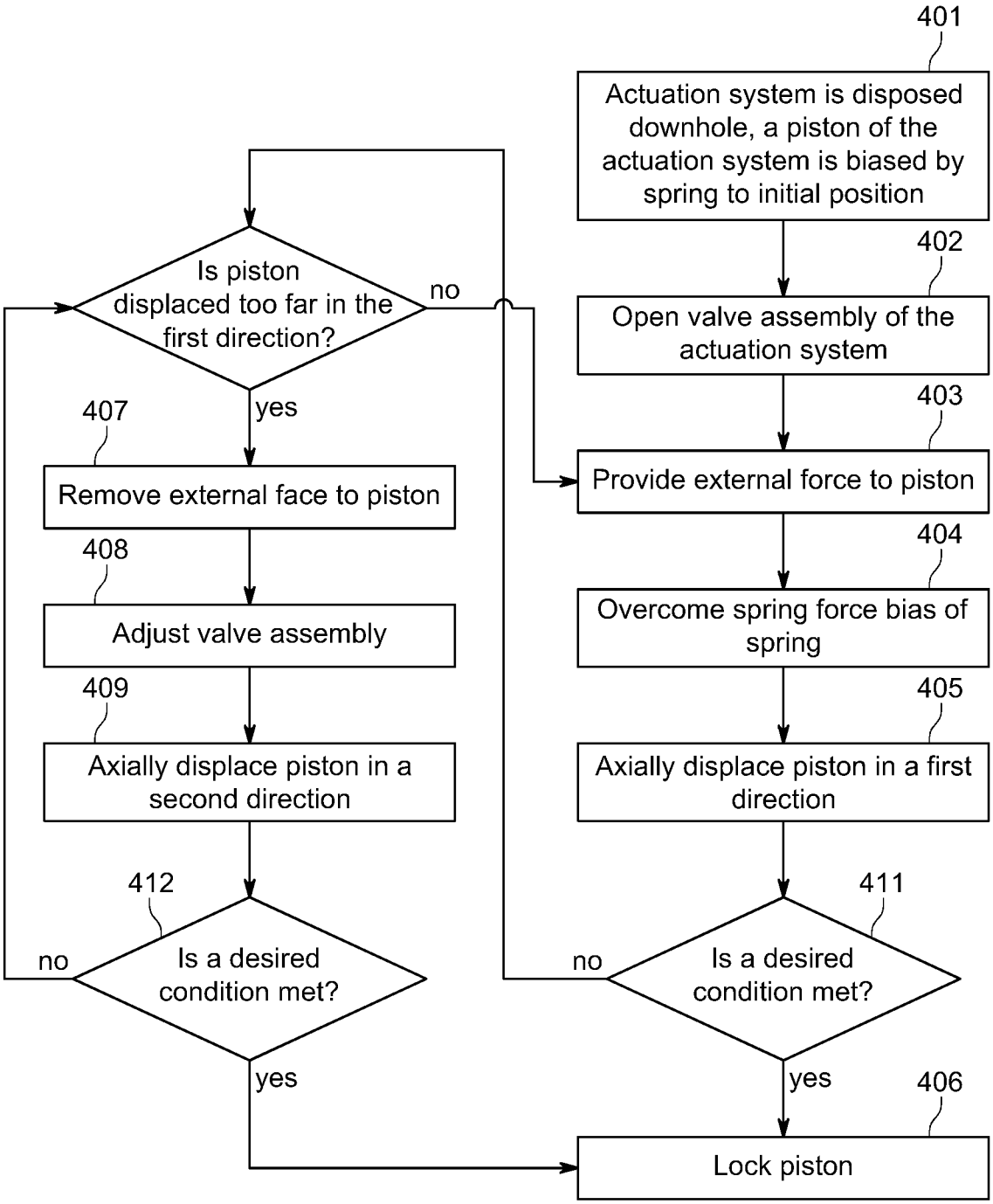
FIG. 25 is a diagram of a method for actuating a flow diverter according to an embodiment of the present disclosure.

FIG. 25 is a diagram of a method for actuating a flow diverter 16 utilizing the actuation system 20 according to an embodiment of the present disclosure. Prior to operation, the drill string 14, including actuation system 20, is disposed downhole. Piston 23 of the actuation system 20 is biased by spring 27 toward the up-hole direction (401). The valve assembly 29 may be opened to allow fluid to flow into interior chamber 25 and pressurize piston 23 (402).

During operation, an external force (of the actuation system 20) may be applied to the piston (403). For example, a downward force may be provided by a flow of fluid downhole. The fluid may be sent downhole such that at least a first portion of the fluid flow enters the choke housing. The second portion of the fluid flow may be directed directly downhole to the bottom hole assembly (BHA). One having ordinary skill in the art will appreciate that other means may be used to provide a force to the piston 23 to overcome the spring force, for example, differential pressure acting on an upstream component having various geometries may be used to act on the piston to overcome the spring bias. Once the external force overcomes the spring force bias of spring 27 (404), the piston 23 will be axially displaced in a first direction (405). The axial displacement of piston 23 may depend, for example, on the flow rate of fluid to the actuation system 20, the duration of the flow of fluid, and the spring constant of spring 27. One having ordinary skill in the art will appreciate that other factors may also affect the axial displacement of piston 23. Referring to FIG. 3, the piston will compress the spring 27 and be axially displaced in a downhole direction.

Once the first portion of fluid flow causes the piston 23 to be axially displaced in a direction downhole, an operator may determine whether or not a desired condition is met (411). A desired condition may include, for example, a pre-defined pressure within the actuation system 20, a pre-defined axial displacement of piston 23, or a pre-defined flow rate to actuation system 20. Once the desired condition is met, the piston 23 may be locked in place (406). Locking the 23 piston in place may be accomplished by closing the valve assembly 29, thereby fluidly isolating interior chamber 25. By locking the piston in place within the housing, a set fluid flow through the actuation system may be maintained.

Calibration may be performed to in order to determine a signal corresponding to the desired condition. For example, a flow of fluid may initially be provided to the flow diverter while the flow diverter is in a closed position (i.e. the plurality of chokes 50 are closed). Because the plurality of chokes 50 are in the closed position, the fluid being sent downhole will flow to the BHA assembly (i.e. corresponds to the first flow of fluid). The flow rate of the flow of fluid provided for calibration purposes may correspond to the flow rate desired at the BHA. The flow of fluid may be provided for a predetermined time interval, e.g. about 30 seconds to a minute, although other time intervals may be used without departing from the scope of this disclosure. During the predetermined time interval, the flow rate of the flow of fluid may be monitored with, for example, a turbine, pressure sensor, position sensor, or any other monitoring means known in the art. As the flow is being provided continuously throughout the predetermined time interval, the flow signal corresponding to the desired flow rate to the BHA may be determined, e.g. a rotations per minute signal, position signal, or pressure signal. Thus, an operator will know that the desired condition is met when receiving the flow signal corresponding to the desired BHA flow. After calibration is performed and before using the flow diverter 16, the flow of fluid to the flow diverter 16 is stopped and the valve 25 of the actuation system may be opened thereby allowing spring 27 to open piston 23, which in turn opens the plurality of chokes 50.

If a desired condition is not met, then fluid flow may continue to be provided downhole and may be decreased or increased to displace the piston further in the first direction or a second direction. For example, referring again to FIG. 3, if a desired condition is not met, the piston 23 may be moved in an up-hole direction. One having ordinary skill will understand that depending on the relative position of the piston 23, spring 27, and valve assembly 29, the first direction may be an up-hole direction, while the second direction may be a downhole direction (409). The piston 23 may be axially moved in a second direction, if for example the first portion of the fluid flow causes the piston to be axially displaced too far in the first direction. Axially moving the piston 23 in the second direction may be accomplished first by removing the external force on piston 23 (407). This may be accomplished by, for example, stopping a flow of drilling fluid. Next, the operator may adjust the valve assembly 29 to pressurize or depressurize the interior chamber 25 accordingly (408). Then, spring force may urge the piston 23 in the second direction (409). This process of axially moving the piston in an up-hole and downhole direction may continue until a desired condition is met (412). Once the desired condition is met, the piston 23 may be locked in place (406).

While the present disclosure includes a limited number of embodiments, those skilled in the art, having benefit of this disclosure, will appreciate that other embodiments can be devised which do not depart from the scope of what has been invented. For example, according to some embodiments, the first portion of fluid flow may be used to actuate a downhole tool instead of being delivered to an annulus of a borehole. Accordingly, the scope of the present disclosure should be limited only by the attached claims.

What is claimed is:

1. An apparatus comprising:
a choke housing;
a plurality of chokes disposed in the choke housing;
a plurality of choke seats disposed within the choke housing for receiving each of the plurality of chokes;
an operating rod, that is axially movable, coupled to the plurality of chokes for selectively opening and closing the plurality of chokes between a fully open and a fully closed position; and
a fluid channel that extends through a wall of the choke housing,
wherein the apparatus further comprises at least one selected from:
a drill collar having the choke housing is disposed concentrically therein; and
a bypass element disposed above the choke housing, wherein the bypass element splits flow between a first portion of fluid flow and a second portion of fluid flow.

2. The apparatus of claim 1, wherein an outer cavity is formed between the drill collar and the choke housing and an inner cavity is formed between the plurality of chokes and the plurality of choke seats.

3. The apparatus of claim 1, further comprising a sleeve disposed concentrically within the choke housing, the sleeve defining an inner cavity.

4. The apparatus of claim 3, wherein an outer cavity is formed between the plurality of chokes and the plurality of choke seats.

5. The apparatus of claim 1, wherein a plurality of stabilizer fins are coupled to an external surface of the drill collar.

6. The apparatus of claim 1, wherein an inner tubular member is disposed concentrically within the choke housing above the plurality of chokes and is configured to move longitudinally upward and downward to selectively close and open the bypass element.

7. The apparatus of claim 1, wherein the plurality of chokes and the plurality of choke seats arc conical in shape or disc shaped.

8. The apparatus of claim 1, further comprising a master valve operatively coupled to the operating rod.

9. The apparatus of claim 8, wherein the master valve is configured to axially move the operating rod.

10. A system comprising:
a flow diverter including:
a bypass element,
the choke housing of the apparatus of claim 1 disposed downhole from the bypass element; and
an actuation system operatively coupled to the flow diverter for actuating the plurality of chokes between at least one fully open and at least one fully closed position.

11. The system of claim 10, wherein the actuation system comprises:
a housing;
a piston disposed in the housing;
an interior chamber formed within the piston;
a spring configured to bias the piston; and
a valve disposed proximate the piston in fluid communication with the interior chamber.

12. The system of claim 10, wherein the actuation system receives instructions from one selected from a group consisting of an operator at a surface, a signal from a measurement while drilling tool, and a signal from a logging while drilling tool.

13. A method comprising:
providing the system of claim 10;
operatively coupling the actuation system to the flow diverter of a tool;
providing a flow of fluid to the flow diverter;
splitting the flow of fluid with the bypass element between a first flow of fluid directed through an inner cavity of the flow diverter and a second flow of fluid directed through an outer cavity, the outer cavity disposed between an outer wall of the flow diverter and an inner wall of the tool; and
axially displacing a piston of the actuation system with the first flow of fluid, thereby axially displacing an operating rod operatively coupled to a plurality of chokes disposed in the flow diverter.

14. The method of claim 13, further comprising directing a bypass flow of fluid out of the flow diverter.

15. The method of claim 13, further comprising opening a master valve, thereby allowing the first flow of fluid to enter the inner cavity of the flow diverter.

16. The method of claim 13, further comprising opening a master valve, thereby allowing the first flow of fluid to enter a fluid channel in fluid communication with an external region of the flow diverter after flowing through the inner cavity of the flow diverter.

17. The method of claim 13, further comprising:

providing a drop ball to the flow diverter; and seating the drop ball in a drop ball tube, thereby preventing the first flow of fluid from entering the inner cavity.

18. The method of claim 17, wherein the drop ball applies an axial force to the operating rod, thereby closing the plurality of chokes disposed within the choke housing.

* * * * *